US009997833B2

(12) United States Patent
Lee et al.

(10) Patent No.: US 9,997,833 B2
(45) Date of Patent: Jun. 12, 2018

(54) ANTENNA

(71) Applicant: EMW CO., LTD., Incheon (KR)

(72) Inventors: Kyoung Ho Lee, Gyeonggi-do (KR); Young Tae Kim, Daegu (KR); Won Mo Seong, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 17 days.

(21) Appl. No.: 15/103,448

(22) PCT Filed: Dec. 8, 2014

(86) PCT No.: PCT/KR2014/012019
§ 371 (c)(1),
(2) Date: Jun. 10, 2016

(87) PCT Pub. No.: WO2015/088214
PCT Pub. Date: Jun. 18, 2015

(65) Prior Publication Data

US 2016/0315387 A1 Oct. 27, 2016

(30) Foreign Application Priority Data

Dec. 11, 2013 (KR) ..... 10-2013-0154213

(51) Int. Cl.

| | |
|---|---|
| ***H01Q 1/24*** | (2006.01) |
| ***H01Q 5/371*** | (2015.01) |
| ***H01Q 9/14*** | (2006.01) |
| ***H01Q 13/10*** | (2006.01) |
| ***H01Q 1/36*** | (2006.01) |
| ***H01Q 1/48*** | (2006.01) |

(Continued)

(52) U.S. Cl.
CPC ..... *H01Q 5/371* (2015.01); *H01Q 1/243* (2013.01); *H01Q 1/36* (2013.01); *H01Q 1/38* (2013.01); *H01Q 1/48* (2013.01); *H01Q 7/00* (2013.01); *H01Q 9/14* (2013.01); *H01Q 13/10* (2013.01); *H01Q 13/106* (2013.01)

(58) Field of Classification Search
CPC ..... H01Q 1/243; H01Q 13/10
USPC ..... 343/702
See application file for complete search history.

(56) References Cited

U.S. PATENT DOCUMENTS

| | | | | |
|---|---|---|---|---|
| 9,105,966 | B1 * | 8/2015 | Dou | H01Q 1/243 |
| 2004/0207559 | A1 * | 10/2004 | Milosavljevic | H01Q 1/243 343/702 |

(Continued)

FOREIGN PATENT DOCUMENTS

| | | | |
|---|---|---|---|
| KR | 10-2005-0026334 | A | 3/2005 |
| KR | 10-2008-0047874 | A | 5/2008 |
| KR | 10-2009-0060105 | A | 6/2009 |

OTHER PUBLICATIONS

International Search Report for PCT/KR2014/012019.

*Primary Examiner* — Dameon E Levi
*Assistant Examiner* — Hasan Islam
(74) *Attorney, Agent, or Firm* — The PL Law Group, PLLC

(57) ABSTRACT

An antenna using a length-adjustable slit includes a power supply line connected to a ground pad and a power supply pad for receiving a power supply signal from a PCB, the ground pad being connected to a case, a radiator formed on the case, the radiator including at least one slit having a dielectric embedded in the slit, and a plurality of switching terminals for controlling the resonant frequency of the slit.

8 Claims, 10 Drawing Sheets

(51) Int. Cl.
*H01Q 7/00* (2006.01)
*H01Q 1/38* (2006.01)

(56) References Cited

U.S. PATENT DOCUMENTS

| | | | | |
|---|---|---|---|---|
| 2009/0256759 | A1* | 10/2009 | Hill | H01Q 1/243 343/702 |
| 2013/0038494 | A1* | 2/2013 | Kuonanoja | H01Q 9/145 343/746 |
| 2013/0234897 | A1* | 9/2013 | Yoon | H01Q 1/243 343/700 MS |

* cited by examiner

ANTENNA

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/012019, filed Dec. 8, 2014, which claims priority to the benefit of Korean Patent Application No. 10-2013-0154123 filed in the Korean Intellectual Property Office on Dec. 11, 2013, the entire contents of which are incorporated herein by reference.

TECHNICAL FIELD

The present invention relates to a multi-band antenna using a multi-stage slit.

BACKGROUND ART

Generally, antennas installed in mobile terminals including mobile communication functions may be largely divided into external antennas and embedded antennas according to installation positions.

A whip type antenna, a helical type antenna, and the like are mainly used as an external antenna. The external antenna has a structure which is inserted and removed by a user by being fixedly installed at a side surface or an upper portion of the mobile terminal.

Since the above external antenna is installed outside the mobile terminal, the mobile terminal is difficult to use and keep, and an exterior of the mobile terminal may be damaged. Further, since an installation space for the external antenna should be ensured at the outside of the mobile terminal, there may be a constraint on an exterior design of the mobile terminal, the design may be damaged and it is difficult to miniaturize and slim the mobile terminal.

In order to compensate for the above-described disadvantages of the external antenna, an embedded antenna method in which an antenna is installed inside a mobile terminal is mainly being used in recent years.

A monopole type antenna, a loop type antenna, or a planar inverted-F antenna (PIFA) is used as the embedded antenna (or an intenna). Since the embedded antenna is installed inside the mobile terminal, a space in which the embedded antenna may be installed should be provided at the inside of the mobile terminal. The installation space of the embedded antenna is reduced as the mobile terminal is slimmed or miniaturized.

Further, recently, as mobile terminals are being slimed and miniaturized, the number of mobile terminals which have an external case formed of a metal material for robustness and elegant, design of the mobile terminal is increased.

However, a metal structure makes radiation of an antenna difficult, and may handle only a limited band even when the antenna is implemented. Therefore, in the mobile terminal having a metal structure, the metal case is being limitedly applied to only a portion other than an antenna area.

SUMMARY

The embodiments of the present invention are directed to providing an antenna implemented inside a metal case by embedding a dielectric in a multi-stage slit formed in the metal case.

Further, the embodiments of the present invention are directed to providing an antenna having a variable frequency characteristic through a switching terminal capable of adjusting a length of a slit.

One aspect of the present invention provides an antenna including a power supply line connected to a ground pad, and a power supply pad for receiving a power supply signal from a printed circuit board (PCB), wherein the ground pad is connected to a case, a radiator formed on the case and including at least one slit having a dielectric embedded therein, and a plurality of switching terminals configured to control a resonant frequency of the radiator.

In the antenna, the plurality of switching terminals may adjust a length of each slit.

In the antenna, the case may be formed of a metal.

In the antenna, the power supply line may be formed on a substrate to have a loop type connected to the ground pad and the power supply pad.

In the antenna, the radiator may include a first slit and a second slit for radiating signals in different frequency bands and the plurality of switching terminals may include first and second switching terminals, which are turned on or off according to a switching control signal received from the PCB and adjust a length of the first slit, and third and fourth switching terminals, which are turned on or off according to a switching control signal received from the PCB and adjust a length of the second slit.

In the antenna, the first slit and the second slit may overlap and may be connected in a predetermined area.

In the antenna, the first slit may be formed to have a loop type and included in a loop of the power supply line.

In the antenna, the second slit may have a T shape.

According to embodiments of the present invention, since an antenna is formed by inserting a dielectric into a slit, a radiation characteristic of an antenna formed in a metal case can be improved.

Further, according to the embodiments of the present invention, since a switching structure for adjusting a physical length of a slit is added, an antenna that may have a variable frequency characteristic can be implemented.

DETAILED DESCRIPTION

Hereinafter, embodiments of an antenna in the present invention will be described in detail with reference to FIGS. 1 to 10. However, these embodiments are only examples and the present invention is not limited thereto.

When the present invention is described, if it is determined that detailed descriptions of known technology related to the present invention unnecessarily obscure the subject matter of the invention, detailed descriptions thereof will be omitted. Some terms described below are defined by considering functions in the invention and meanings may vary depending on, for example, a user or operator's intentions or customs. Therefore, the meanings of terms should be interpreted based on the scope throughout this specification.

The spirit and scope of the present invention are defined by the appended claims. The following embodiments are only made to efficiently describe the technological scope of the invention to those skilled in the art.

In the following embodiments of the present invention, a high-frequency band may include a digital cordless system (DCS) (in a range of 1710 MHz to 1880 MHz), personal communication services (PCS) (in a range of 1850 MHz to 1990 MHz), a wideband code division multiple access (WCDMA) (in a range of 1920 MHz to 2170 MHz), and the like, and a low-frequency band may include a global system for mobile telecommunication (GSM) (in a range of 880 MHz to 960 MHz).

Figure 1:
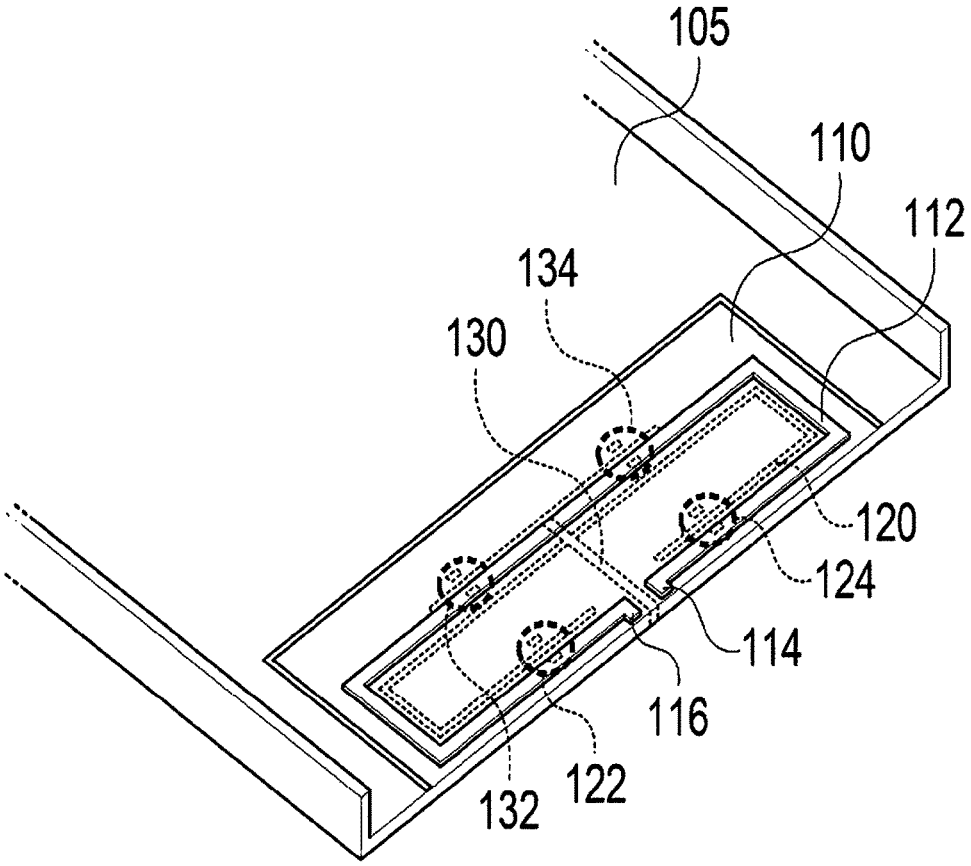
FIG. 1 is a front perspective view of an antenna according to an embodiment of the present invention.

FIG. 1 is a front perspective view of an antenna 100 according to an embodiment of the present invention.

Referring to FIG. 1, the antenna 100 may include a substrate 110 on which a power supply line 112, a power supply pad 114, and a ground pad 116 are formed, first and second radiators 120 and 130 which are formed using slits, and a metal rear case 105 including first to fourth switching terminals 122, 124, 132, and 134.

The substrate 110 in FIG. 1 may be formed of, for example, a dielectric having a predetermined dielectric constant. Here, the substrate 110 may be formed of a member having a predetermined dielectric constant and magnetic permeability. For example, the substrate 110 may be formed of a ferrite sheet, but the present invention is not limited thereto.

In FIG. 1, the power supply line 112 formed on the substrate 110 may be connected to a printed circuit board (PCB, hereinafter referred to as a PCB) (not illustrated) through the power supply pad 114.

The above power supply line 112 may supply power using a power supply function, for example, using a coupling power supply method by receiving a signal from the power supply pad 114. Meanwhile, in a predetermined embodiment, although the power supply line 112 is described to supply power using the coupling power supply method as an example, the power supply line 112 may supply power using various power supply methods. The first radiator 120 and the second radiator 130 operate as the antenna 100 according to the power supply.

Further, the power supply line 112 may be disposed on a different plane from the first radiator 120 and the second radiator 130. Specifically, since the power supply line 112 is formed on the substrate 110 and the first radiator 120 and the second radiator 130 are formed on the metal rear case 105, the power supply line 112 may be formed separately from the first radiator 120 and the second radiator 130 by as much as a thickness of the substrate 110.

Meanwhile, the power supply line 112 may be formed on the substrate 110 to have a shape which surrounds the first radiator 120 by being spaced apart from the metal rear case 105 by a predetermined interval to, for example, have a loop type which surrounds the first radiator 120.

The ground pad 116 is connected to the metal rear case 105 as well as the PCB. Specifically, the ground pad 116 may ground the metal rear case 105 and the PCB.

The first and second radiators 120 and 130 are formed separately from the power supply line 112 by as much as the thickness of the substrate 110, and accordingly, coupling occurs between the first and second radiators 120 and 130 and the power supply line 112.

The first radiator 120 may process a signal in a high-frequency band through the coupling with the power supply line 112, and may be formed inside the power supply line 112.

Further, a resonant frequency of the first radiator 120 in a high-frequency band may be adjusted by changing a physical length of the first radiator 120. The physical length of the first radiator 120 may be changed by the first and second switching terminals 122 and 124.

The second radiator 130 may process a signal in a low-frequency band through the coupling with the power supply line 112.

The second radiator 130 is formed to have a T shape and may be connected to the first radiator 120 by overlapping a predetermined portion thereof with the first radiator 120.

As described above, in the predetermined embodiment, the first and second radiators 120 and 130 may be formed on the same plane in a form connected to each other through the predetermined portion.

Slits are formed in the metal rear case 105, and then the above first and second radiators 120 and 130 may be formed by embedding a dielectric having a predetermined dielectric constant into the slits. A structure of the above slits for forming the first and second radiators 120 and 130 will be described with reference to FIG. 2.

Figure 2:
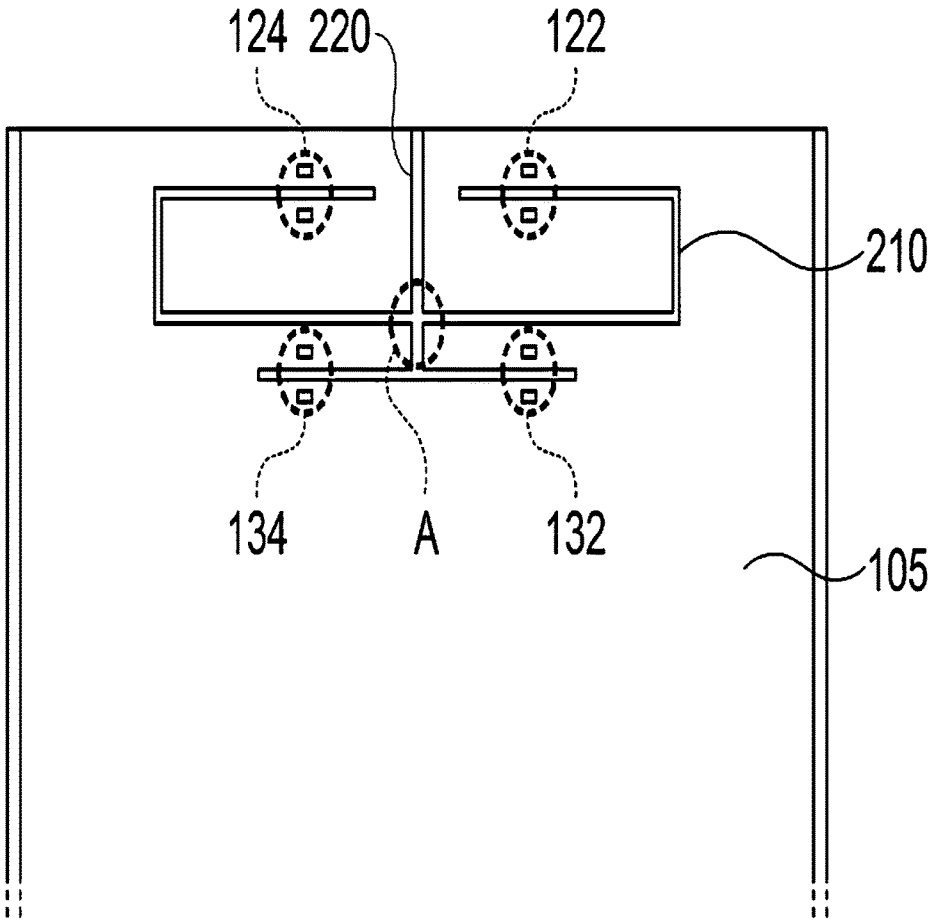
FIG. 2 is a view for describing a slit structure according to an embodiment of the present invention.

FIG. 2 is a view illustrating the slits and the first to fourth switching terminals 122, 124, 132, and 134 which are formed on the metal rear case 105 according to the embodiment of the present invention.

As illustrated in FIG. 2, a first slit 210 having a loop type and a second slit 220, which has a T shape and is connected to the first slit 210, are formed in the metal rear case 105. Next, the first and second radiators 120 and 130 may be formed by embedding dielectrics having a predetermined dielectric constant into the first and second slits 210 and 220. In this case, a loop of the first slit 210 may be formed to have a size smaller than a size of a loop of the power supply line 112.

Further, the first slit 210 and the second slit 220 may be formed in the metal rear case 105 to overlap in an arbitrary portion A, and may be connected to each other through the portion A.

The above dielectrics of the first slit 210 and second slit 220 may be formed by a double injection method or an insert injection method.

Then, the switching terminals 122, 124, 132, and 134 for adjusting lengths of the first slit 210 and the second slit 220 are formed on the metal rear case 105.

The first and second switching terminals 122 and 124, which are means for adjusting the length of the first slit 210, may be selectively turned on or off. Specifically, since the length of the first slit 210 is reduced according to ON operations of the first and second switching terminals 122 and 124, a resonant frequency processed by the first radiator 120 may be lowered.

The above first and second switching terminals 122 and 124 may receive a switching operation control signal from the PCB, and adjust the length of the first slit 210 by performing ON or OFF operations according to the switching operation control signal.

The third and fourth switching terminals 132 and 134, which are means for adjusting the length of the second slit 220, may be selectively turned on or off. Specifically, the length of the second slit 220 is reduced according to ON operations of the third and fourth switching terminals 132 and 134, and a resonant frequency processed by the second radiator 130 may be lowered.

The above third and fourth switching terminals 132 and 134 may receive the switching operation control signal from the PCB, and perform ON or OFF operations.

In the antenna 100 having the above structure, results in which resonant frequencies are changed according to the ON/OFF operations of the first to fourth switching terminals 122, 124, 132, and 134 will be described with reference to FIGS. 3 and 4.

Figure 3:
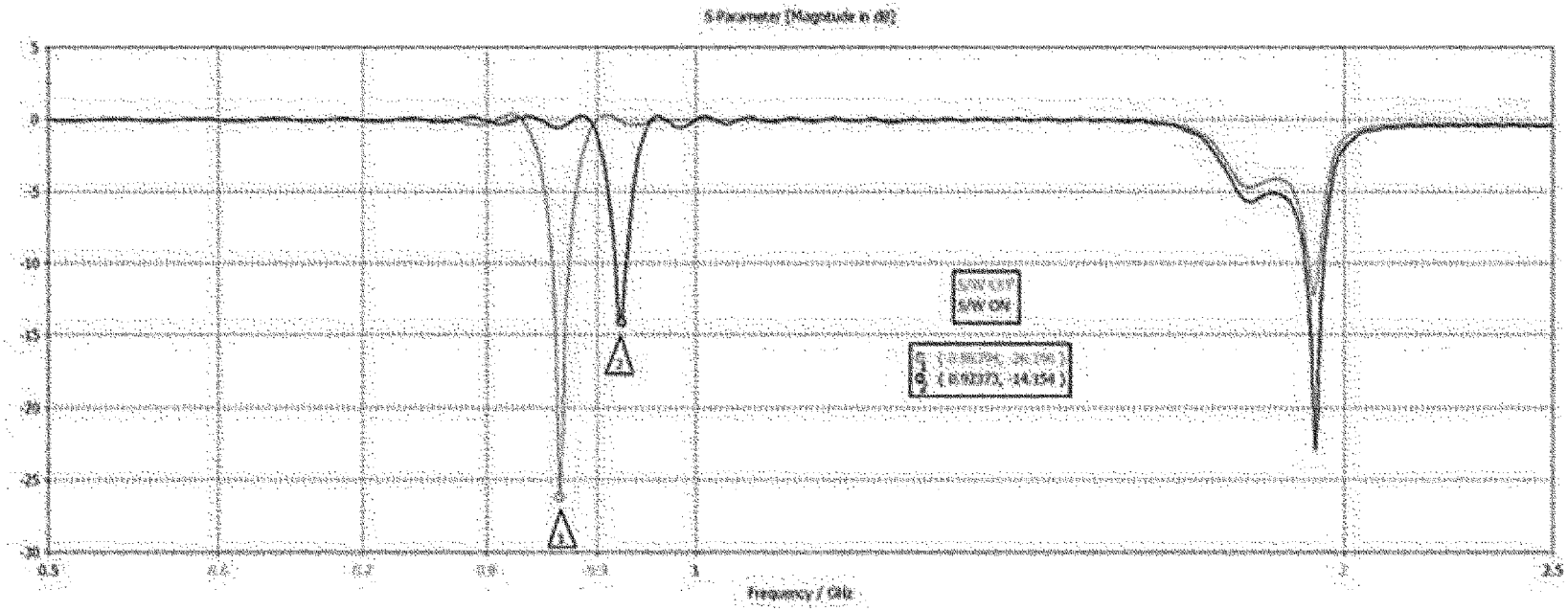
FIGS. 3 and 4 are views illustrating results in which a resonant frequency of an antenna according to an embodiment of the present invention is changed according to on/off operations of first to fourth switching terminals.
Figure 4:
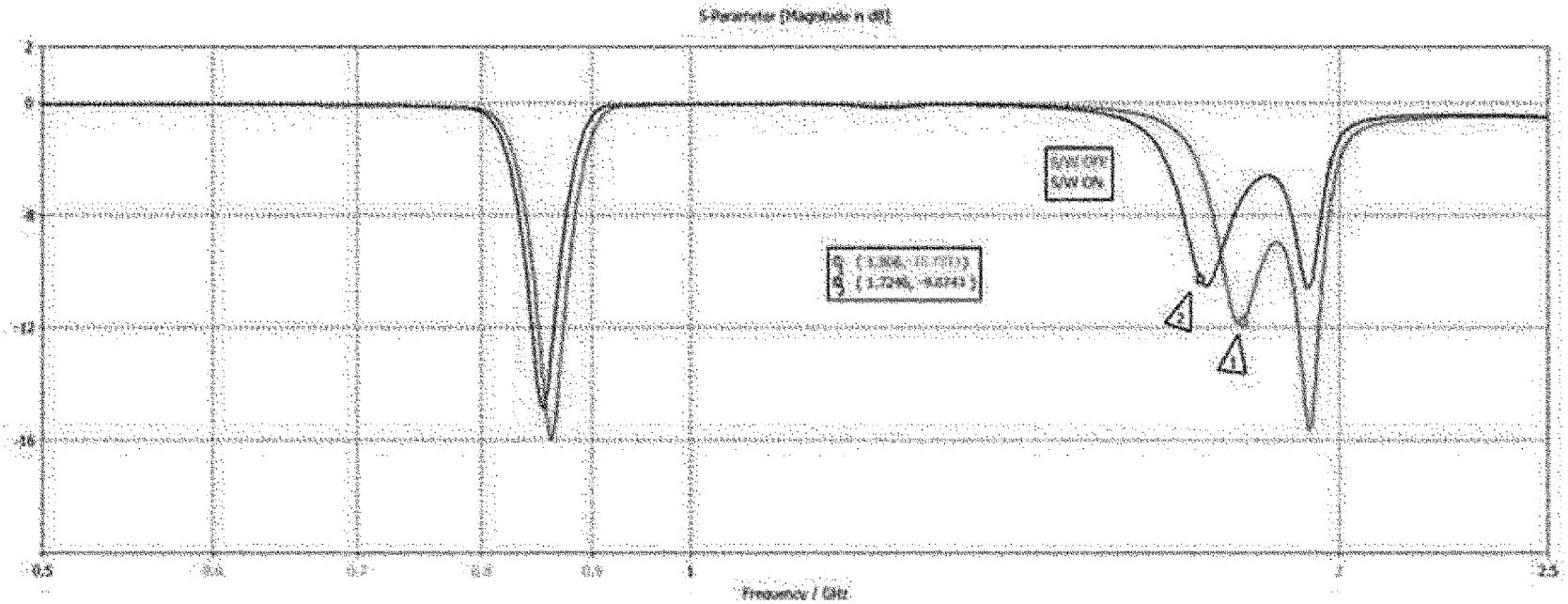

FIGS. 3 and 4 are views illustrating results in which a resonant frequency of the antenna 100 according to the embodiment of the present invention is changed according to the ON/OFF operations of the first to fourth switching terminals 122, 124, 132, and 134.

FIG. 3 is a view illustrating results in which the resonant frequency is moved when the first and second switching terminals 122 and 124 are turned off and on.

As illustrated in FIG. 3, since the length of the first slit 210 is smaller when the first and second switching terminals 122 and 124 are turned on than when the first and second switching terminals 122 and 124 are turned off, it may be seen that the resonant frequency of the first radiator 120 is increased.

FIG. 4 is a view illustrating results in which the resonant frequency is moved when the third and fourth switching terminals 132 and 134 are turned off and on.

As illustrated in FIG. 4, since the length of the second slit 220 is smaller when the third and fourth switching terminals 132 and 134 are turned on than when the third and fourth switching terminals 132 and 134 are turned off, it may be seen that the resonant frequency of the second radiator 130 is lowered.

Figure 5:
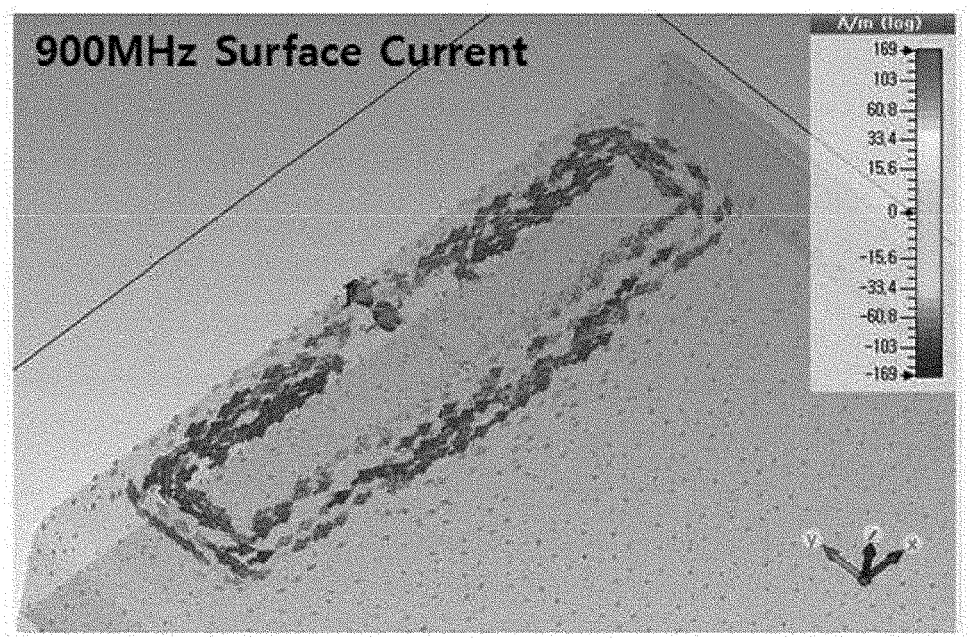
FIGS. 5 to 7 are views for describing slit portions in which resonance occurs in an antenna according to an embodiment of the present invention.
Figure 6:
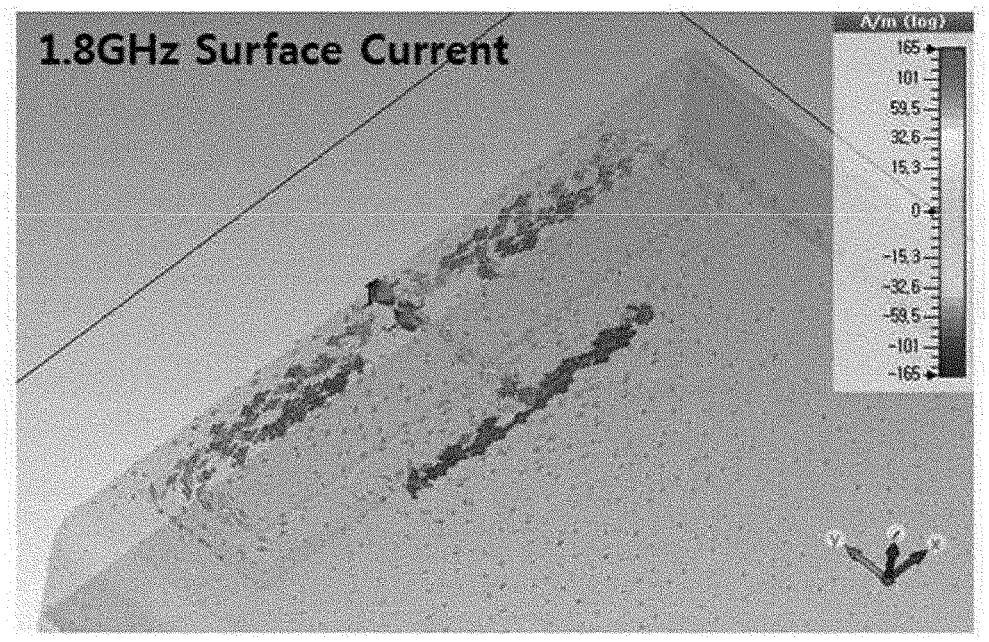
Figure 7:
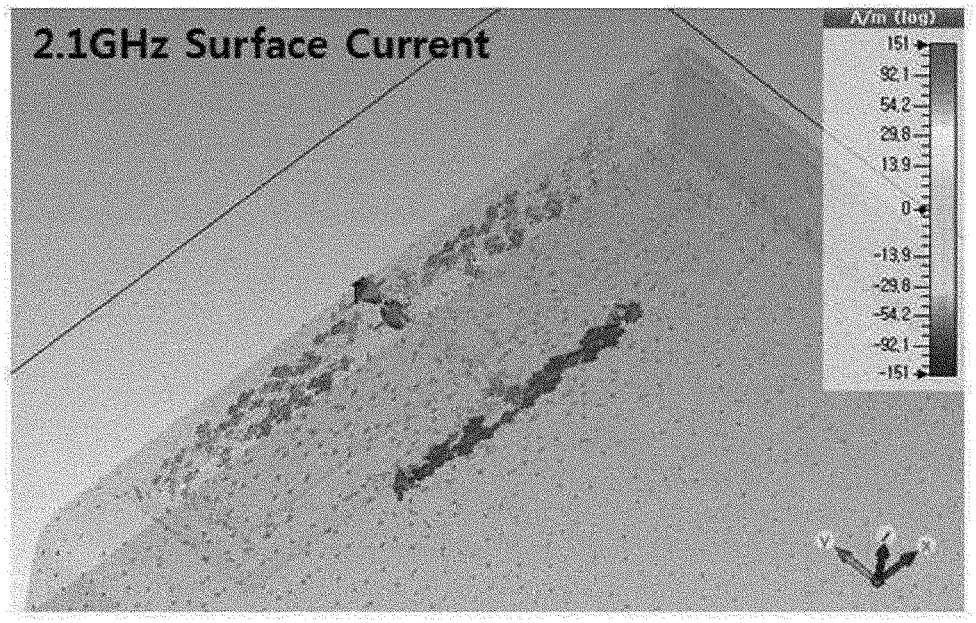

When the antenna 100 having the above-described structure is implemented, it may be seen that a first resonance occurs through the first radiator 120 having the first slit 210, a second resonance occurs through a frequency which is multiplied by the first radiator 120 having the first slit 210, and a third resonance occurs through the second radiator 130 having the second slit 220 as illustrated in FIGS. 5 to 7.

Specifically, it may be seen that a resonance occurs at 900 MHz by the first radiator 120 having the first slit 210 as illustrated in FIG. 5, a resonance occurs at 1.8 GHz by the frequency which is multiplied by the first radiator 120 having the first slit 210 as illustrated in FIG. 6, and a resonance occurs at 2.1 GHz by the second radiator 130 having the second slit 220.

Figure 8:
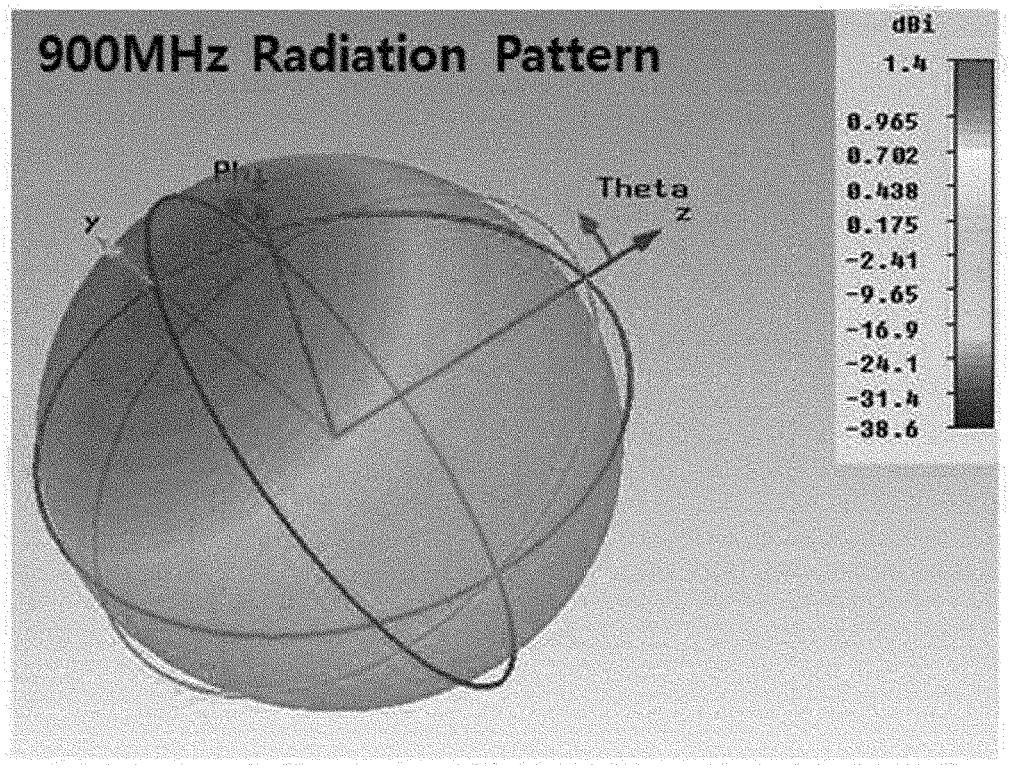
FIGS. 8 to 10 are views illustrating radiation patterns of an antenna when resonance occurs.
Figure 9:
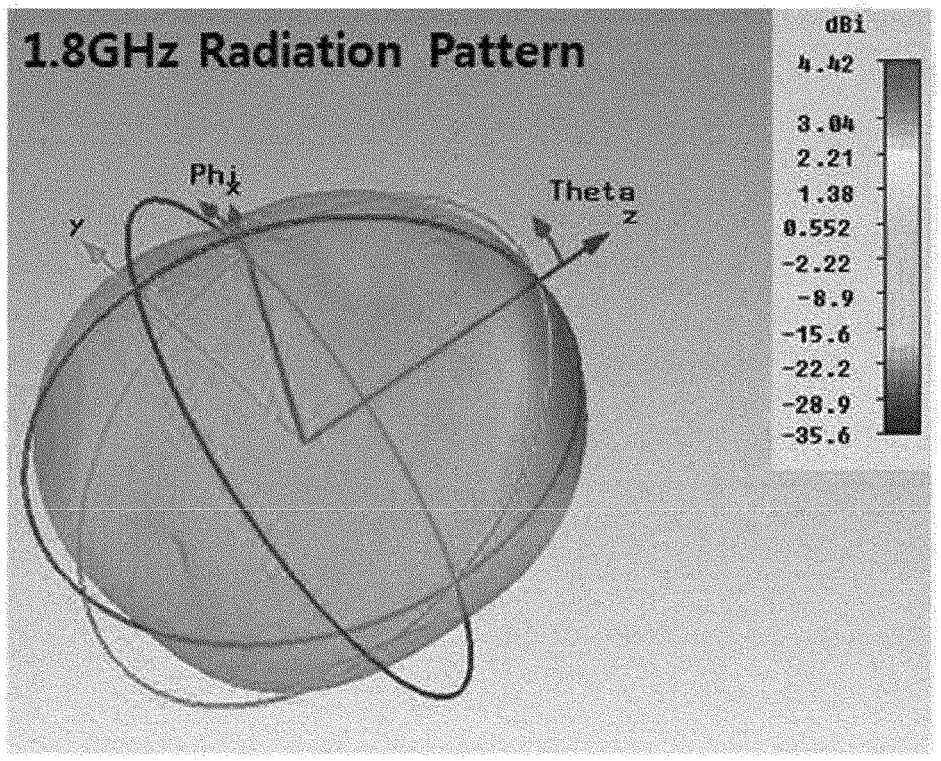
Figure 10:
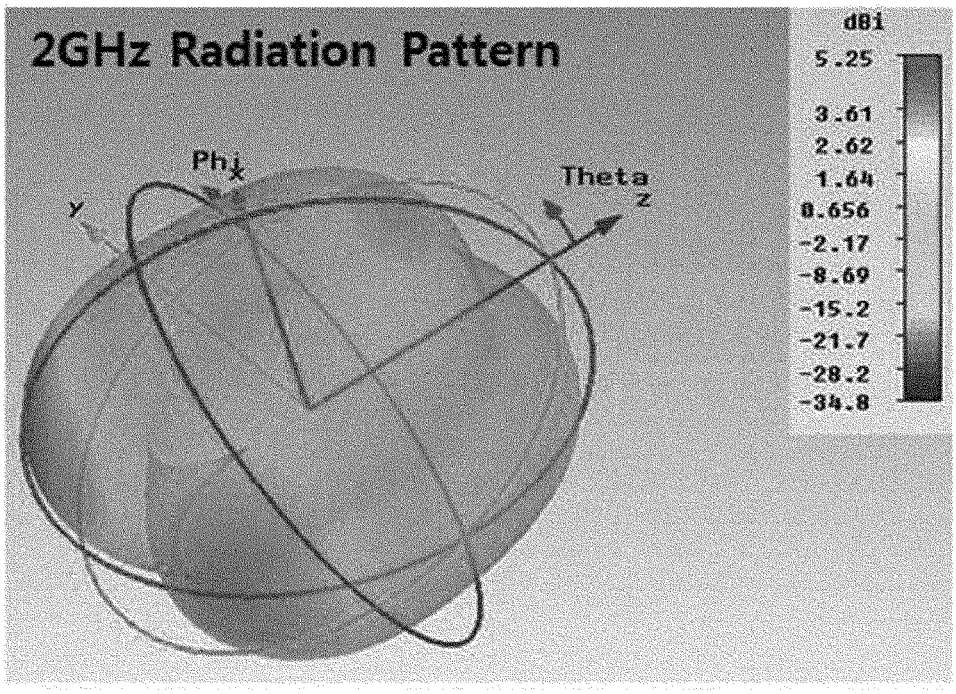

When the resonances occur as illustrated in FIGS. 5 to 7, radiation patterns of the antenna 100 are as illustrated in FIGS. 8 to 10, respectively.

Meanwhile, in the embodiments of the present invention, although the lengths of the slits are described to be adjusted using the four switching terminals in order to implement a multi-band antenna as an example, four or more switching terminals or four or less switching terminals may also be used.

While the present invention has been described above in detail with reference to representative embodiments, it may be understood by those skilled in the art that the embodiment may be variously modified without departing from the scope of the present invention. Therefore, the scope of the present invention is defined not by the described embodiment but by the appended claims, and encompasses equivalents that fall within the scope of the appended claims.

The invention claimed is:

1. An antenna comprising:

a case having at least one slit;

a ground pad connected to the case;

a power supply pad;

a power supply line connected to the ground pad and the power supply pad for receiving a power supply signal from a printed circuit board (PCB);

a radiator formed of a dielectric embedded in the at least one slit of the case, the radiator formed separately from the power supply line to be disposed on a different plane from the power supply line;

a plurality of switching terminals to control a resonant frequency of the radiator; and a substrate formed on the case, wherein the power supply line, the power supply pad, and the ground pad are formed on the substrate.

2. The antenna of claim 1, wherein the plurality of switching terminals adjust a length of each slit.

3. The antenna of claim 1, wherein the case is formed of a metal.

4. The antenna of claim 1, wherein the power supply line is formed on the substrate to have a loop type connected to the ground pad and the power supply pad.

5. The antenna of claim 1, wherein:

the slit includes a first slit and a second slit in each of which the dielectric is embedded for radiating signals in different frequency bands; and the plurality of switching terminals includes first and second switching terminals, which are turned on or off according to a switching control signal received from the PCB and adjust a length of the first slit, and third and fourth switching terminals, which are turned on or off according to a switching control signal received from the PCB and adjust a length of the second slit.

6. The antenna of claim 5, wherein the first slit and the second slit overlap and are connected in a predetermined area.

7. The antenna of claim 5, wherein the first slit is formed to have a loop type and included in a loop of the power supply line.

8. The antenna of claim 5, wherein the second slit has a T shape.

* * * * *